US007658132B2

(12) United States Patent
Taggart, Sr. et al.

(10) Patent No.: US 7,658,132 B2
(45) Date of Patent: Feb. 9, 2010

(54) GEARED SERPENTINE BELT TOOL

(75) Inventors: Kenneth J. Taggart, Sr., Columbia, PA (US); Paul S. Steinweg, Litiz, PA (US)

(73) Assignee: Easco Hand Tools, Inc., Simsbury, CT (US)

( * ) Notice: Subject to any disclaimer, the term of this patent is extended or adjusted under 35 U.S.C. 154(b) by 771 days.

(21) Appl. No.: 10/800,843

(22) Filed: Mar. 15, 2004

(65) Prior Publication Data

US 2004/0200324 A1 Oct. 14, 2004

Related U.S. Application Data

(60) Provisional application No. 60/456,718, filed on Mar. 20, 2003.

(51) Int. Cl.
*B28B 23/16* (2006.01)
*B28B 13/00* (2006.01)

(52) U.S. Cl. ..... 81/177.2; 81/125.1; 81/124.4; 81/177.8; 81/177.85

(58) Field of Classification Search ..... 81/125.1, 81/124.3, 124.4, 124.7, 177.1, 177.8, 177.2, 81/177.85, 180.1, 60–63.2
See application file for complete search history.

(56) References Cited

U.S. PATENT DOCUMENTS 1,305,249 A * 6/1919 Buck ..... 81/58.1
2,691,316 A * 10/1954 Brame ..... 81/177.2
3,039,339 A * 6/1962 Hanson ..... 81/177.2
3,376,768 A * 4/1968 Fortunato ..... 81/177.2
3,996,821 A 12/1976 Murray ..... 81/177.2
4,337,860 A * 7/1982 Carrigan ..... 206/376
4,344,340 A * 8/1982 Erickson ..... 81/177.2
4,596,167 A * 6/1986 White, Jr. ..... 81/177.2
4,865,194 A 9/1989 Decarie ..... 206/378
5,368,164 A * 11/1994 Bennett et al. ..... 206/373
6,367,356 B1 * 4/2002 Stepp ..... 81/177.2

(Continued)

FOREIGN PATENT DOCUMENTS

CN 2116560 U 9/1992 ..... 13/6

OTHER PUBLICATIONS

Brochure for GearWrench; Ratcheting Combination Wrench 12 Piece Metric Set, 1998.

(Continued)

*Primary Examiner*—D. S Meislin
(74) *Attorney, Agent, or Firm*—Nelson Mullins Riley & Scarborough, LLP

(57) ABSTRACT

A tool for removing and installing serpentine belts in vehicles has a drive bar, a double box end wrench and a socket. The drive bar has a handle at a first end and a fitting at an opposite second end that is used to connect to the double box end wrench. The double box end wrench has a first end defining a polygonally shaped opening and an opposite second end that defines a ratcheting wrench having a first plurality of teeth on an inner circumference thereof. The socket defines a second plurality of teeth on an outer circumference thereof that are adapted to be received by the ratcheting wrench first plurality of teeth. The socket also defines one of a polygonally shaped opening and a polygonally shaped tang that is received by a work piece of an vehicle idler pulley.

16 Claims, 3 Drawing Sheets

U.S. PATENT DOCUMENTS

| | | | | |
|---|---|---|---|---|
| 6,427,564 | B1 * | 8/2002 | Nelson | 81/177.2 |
| 7,013,765 | B2 * | 3/2006 | Chang | 81/177.2 |
| 2001/0007213 | A1 * | 7/2001 | Hyatt | 81/124.6 |
| 2004/0035257 | A1 * | 2/2004 | Tuan-Mu | 81/63.2 |
| 2004/0093991 | A1 * | 5/2004 | Wojtynek | 81/57.3 |

OTHER PUBLICATIONS

Brochure for KD Tools; Geared Serpentine Belt Tool; Jan. 2003.
Top 20 Tools Motor Magazine, 1995.
KD Tools Catatog, Sepentine Belt Tool #3414, undated.
Lisle Catalog p. 4, 57900 Serpentine Belt Tool, undated..
Automotive Special Tools Serpentine Belt Tool No. 7644.
International Search Report dated Feb. 8, 2005; PCT/USO4/08446.
KD Tools "Gearwrench Geared Serpentine Belt Tool"; Jan. 30, 2003.
KD Tools "Ratcheting Combination Wrench" 12 Piece Metric Set; Dec. 31, 1998.
Preliminary Examination Report dated Oct. 6, 2005 for PCT/US2004/008446.

* cited by examiner

GEARED SERPENTINE BELT TOOL

PRIORITY CLAIM

The present application claims priority to U.S. Provisional Patent Application No. 60/456,718, filed Mar. 20, 2003, the entire disclosure of which is hereby being incorporated by reference in its entirety.

FIELD OF THE INVENTION

The present invention relates to a tool for use in vehicle repairs. In particular, the present invention relates to a tool for removing serpentine belts in vehicle engines.

BACKGROUND OF THE INVENTION

Serpentine belts are present on most U.S. and import vehicles in the United States. The serpentine belt is the one found in the engine area that connects major vehicle functions, such as water pumps, alternators, air conditioning etc. The belt is spring-loaded and requires a special tool to release the spring tension to remove and replace the belt. Depending on the vehicle, the tension device is moved by placing the tool on either a bolt in the tension arm or a female square drive that is molded into the tension arm. Access to the bolt is limited, and therefore a specialty tool is required.

Approaches to releasing the tension vary, but in all cases there are members that attach to the tool, and the tool is used to fit onto a serpentine belt idler pulley work piece.

SUMMARY OF THE INVENTION

The present invention recognizes and addresses considerations of prior art constructions and methods. In one embodiment of the present invention, a serpentine belt tool for removal and installation of a serpentine belt in a vehicle comprises a drive bar, a double box end wrench and a socket. The drive bar has a handle at a first end and a fitting at an opposite second end that is used to connect the drive bar to the double box end wrench. The double box end wrench has a first end defining a polygonally shaped opening and an opposite second end that defines a ratcheting wrench having a first plurality of teeth on an inner circumference thereof. The socket defines a second plurality of teeth on an outer circumference thereof that are adapted to be received by the ratcheting wrench first plurality of teeth. The socket also defines one of a polygonally shaped opening and a polygonally shaped tang that is received by a work piece of a vehicle idler pulley. The drive bar handle is moveable between a first direction that operates on the idler pulley work piece and a second direction that causes the drive bar handle to move relative to the idler pulley work piece.

BRIEF DESCRIPTION OF THE DRAWINGS

A full and enabling disclosure of the present invention, including the best mode thereof, directed to one of ordinary skill in the art, is set forth in the specification, which makes reference to the appended drawings, in which.

Figure 1:
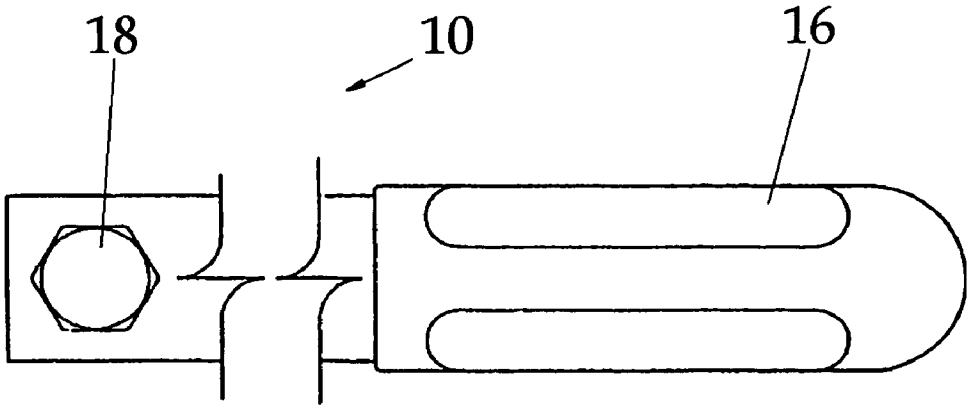
FIG. 1 is a top plan view of a drive bar in accordance with an embodiment of the present invention.

Repeat use of reference characters in the present specification and drawings is intended to represent same or analogous features or elements of the invention.

DETAILED DESCRIPTION OF THE PREFERRED EMBODIMENTS

Reference will now be made in detail to presently preferred embodiments of the invention, one or more examples of which are illustrated in the accompanying drawings. Each example is provided by way of explanation of the invention, not limitation of the invention. In fact, it will be apparent to those skilled in the art that modifications and variations can be made in the present invention without departing from the scope and spirit thereof. For instance, features illustrated or described as part of one embodiment may be used on another embodiment to yield a still further embodiment. Thus, it is intended that the present invention covers such modifications and variations as come within the scope of the appended claims and their equivalents.

Referring to FIGS. 1-4, a serpentine belt tool has a drive bar 10, a double box end wrench 12, and a plurality of various sockets 14 that fit differing drive belt work pieces. Referring particularly to FIG. 1, drive bar 10 has a handle 16 at one end and a fitting 18 at the opposite end. Preferably fitting 18 is a hex head member, but fitting 18 may be any suitable polygonally shaped fitting adapted to receive double box end wrench 12. The length of drive bar 10 may vary as should be well understood in this art.

Figure 2:
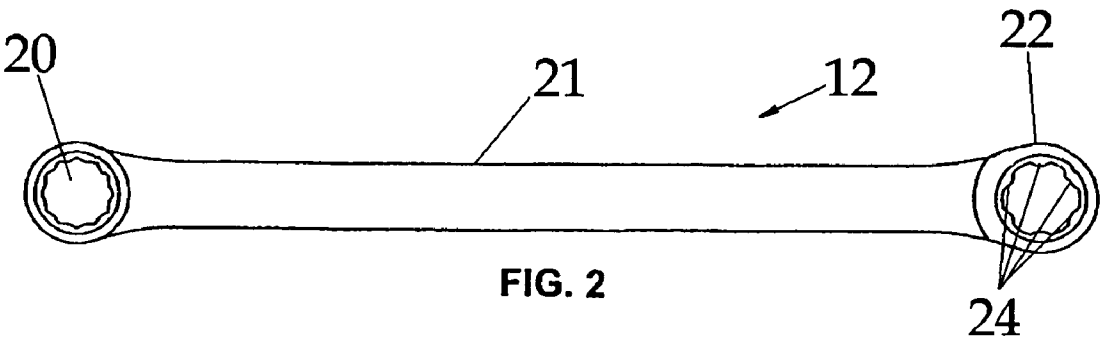
FIG. 2 is a top plan view of a ratcheting wrench for use with the drive bar of FIG. 1.
Figure 3:
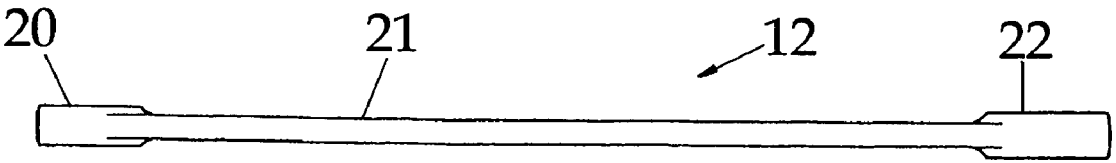
FIG. 3 is a side elevation view of the ratcheting wrench of FIG. 2.

With reference to FIGS. 2-3, double box end wrench 12 has an opening 20 at one end of a handle 21 that cooperates with drive bar fitting 18. Preferably, wrench opening 20 is a hex shaped opening, but it should be understood that wrench opening 20 may be any polygonally shaped opening that is sized and shaped to receive drive bar fitting 18. A ratcheting means 22 is formed on the other end of handle 21.

Preferably, ratcheting means 22 is a ratchet wrench with a plurality of teeth 24 formed on an inner circumference thereof. Teeth 24 may be of any desired spacing, and in a preferred embodiment, plurality of teeth 24 consists of six equally-spaced teeth. Ratcheting wrenches are well known in this art. Therefore, a detailed description of the structure and operation of such wrenches is not included herein.

Figure 4:
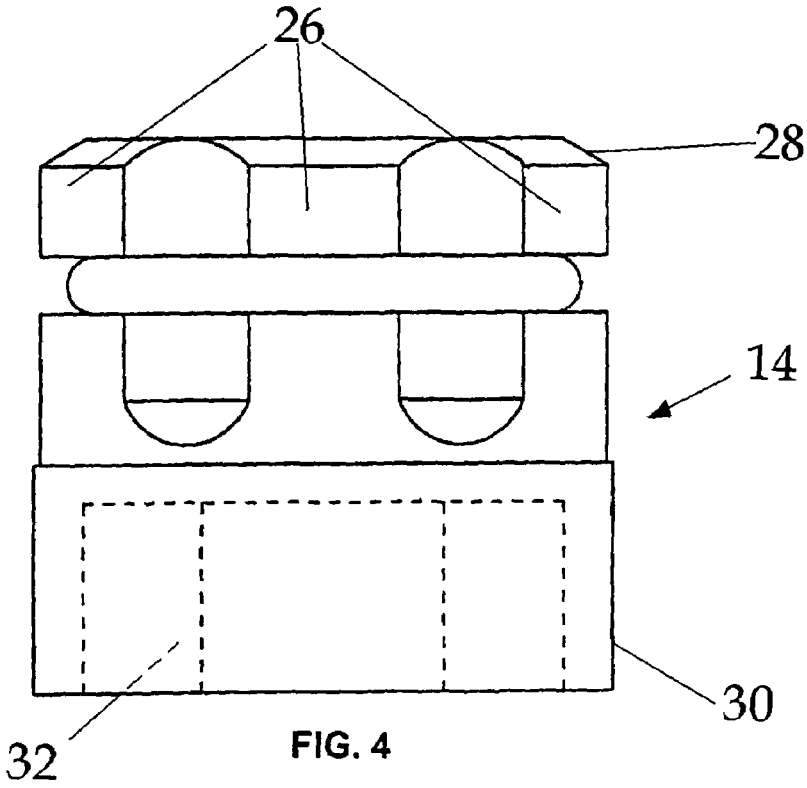
FIG. 4 is a side elevation view of a socket for use with the ratchet of FIG. 2.

Referring to FIG. 4, each socket 14 has a plurality of teeth 26 formed on a first end 28 that cooperate with ratcheting wrench teeth 24. An opposite end 30 of socket 14 has an opening 32 formed therein. Typically, socket opening 32 is polygonally shaped and of standard sizes to fit a work piece on the idler pulley of a vehicle. Moreover, because the idler pulley work piece differs in size and shape among various vehicle manufacturers, more than one socket may be provided for use with ratcheting wrench end 22 to accommodate such variations.

The serpentine belt tool is used by first connecting wrench 12 to drive bar 10. More particularly, polygonally shaped wrench open end 20 receives drive bar fitting 18 to rotationally secure wrench 12 to drive bar 10. Ratcheting wrench end 22 receives socket 14 so that socket teeth 26 are received by and rotationally lock with ratcheting wrench teeth 24. The idler pulley work piece is received by polygonally shaped socket opening 32 and the drive bar is reciprocated to counteract the spring load of the idler pulley to install or remove the serpentine belt.

The present invention provides greater versatility than has been available previously. That is, drive bar 10 may be attached to double box end wrench 12 at many different angles. Moreover, ratcheting wrench 22 provides a means to drive the idler pulley work piece with minimum effort and to index the tool to obtain maximum leverage within the confined space available.

Figures 5, 6, 7:
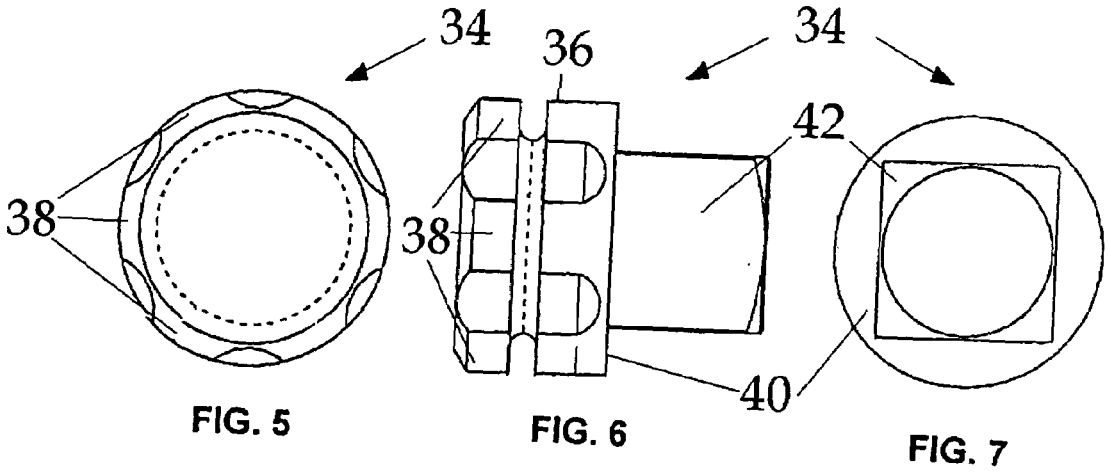
FIG. 5 is a top plan view of a square drive adapter for use with the ratchet of FIG. 2.
FIG. 6 is a side elevation view of the square drive adapter of FIG. 5.
FIG. 7 is a bottom plan view of the square drive adapter of FIG. 5.

Referring to FIGS. 5-7, ratcheting wrench end 22 is also adapted to receive a square drive adapter 34. Square drive adapter 34 has a first end 36 defining a plurality of teeth 38 on an outer circumference thereof and a second end 40 defining a polygonally shaped tang 42. First end teeth 38 are sized and shaped to be received by ratcheting wrench end teeth 24. In a preferred embodiment, polygonally shaped tang 42 is a square tang that is sized to fit into an idler pulley work piece. Because different vehicles have differing sized work pieces, more than one size square drive adapter 34 may be provided to accommodate the varying size work pieces among manufacturers.

Figure 8:
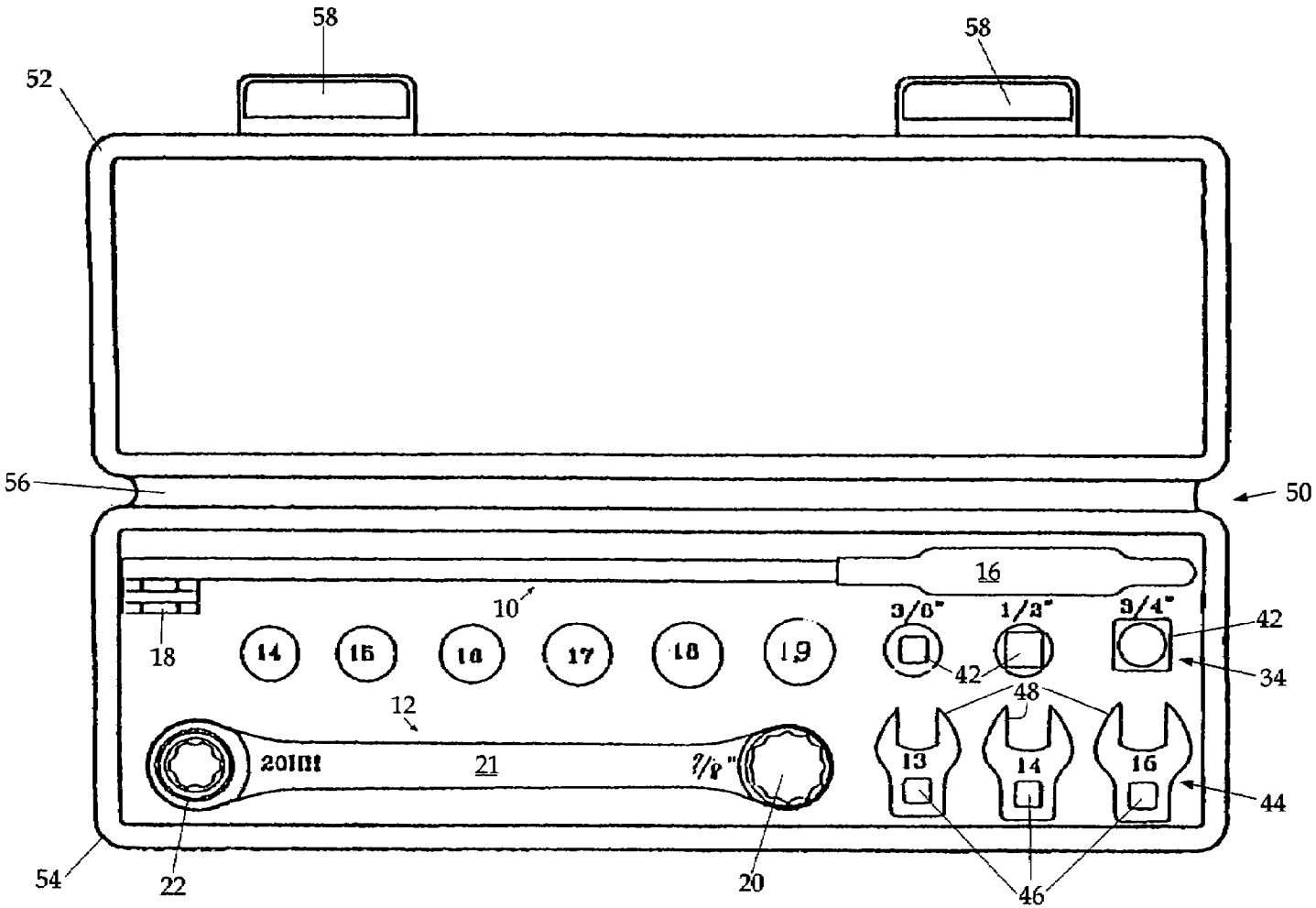
FIG. 8 is a top plan view of a blow molded case for use with the components of FIGS. 1-5.

Referring to FIG. 8, a plurality of crow foot wrenches 44 may be provided to fit on the different sized idler pulley work pieces. Each crow foot wrench 44 has a square opening 46 in one end that receives tang 42 from one of square drive adapters 34. An opposite end of crow foot wrench 44 has an open end wrench 48 for receiving the idler pulley work pieces. It should be understood that multiple crow foot wrenches of varying sizes may be provided to accommodate the varying work pieces among vehicle manufactures.

A blow molded case 50 is formed with a plurality of recesses shaped to receive different parts of the serpentine belt tool. Each recess receives a different component of the tool such as the handle 10, double box end wrench 12, individual sockets 14, individual square drive adapters 34 and individual crow foot wrenches 44. Blow molded case 50 has a top portion 52 connected to a bottom portion 54 by a hinge 56. Two latches 58 lock top portion 52 to bottom portion 54 to secure the contents of the case.

It should be appreciated by those skilled in the art that various modifications and variations can be made in the present invention without departing from the scope and spirit of the invention. It is intended that the present invention cover such modifications and variations as come within the scope and spirit of the appended claims and their equivalents.

What is claimed is:

1. A serpentine belt tool for removal and installation of a serpentine belt in a vehicle comprising:
   a. a drive bar having a handle at a first end and a fitting at an opposite second end, wherein said fitting is disposed at a fixed angle relative to said drive bar;
   b. a double box end wrench having
      a first end defining a polygonally shaped opening that is sized and shaped to receive said drive bar fitting, and
      an opposite second end defining a ratcheting wrench having a first plurality of teeth on an inner circumference thereof; and
   c. a socket having
      a first end defining a second plurality of teeth on an outer circumference thereof, said socket second plurality of teeth being adapted to be received by said ratcheting wrench first plurality of teeth, and
      an opposite second end defining one of a polygonally shaped opening and a polygonally shaped tang adapted to be received by a work piece of a vehicle idler pulley,
   wherein said drive bar handle is moveable between
      a first direction that applies torque to the idler pulley work piece, and
      a second direction that causes said drive bar handle to move relative to said socket.

2. The serpentine belt tool of claim 1, further comprising a crow foot wrench having a first end defining one of a polygonally shaped opening and a polygonally shaped tang therein that receives said one of said socket second end polygonally shaped tang and said polygonally shaped opening, and a second end having an open end wrench formed thereon to receive the idler pulley work piece.

3. The serpentine belt tool of claim 1, further comprising a blow molded case defining a plurality of recessed areas for receiving said drive bar, said double box end wrench and said socket of said serpentine belt tool.

4. A serpentine belt tool for removal and installation of a serpentine belt in a vehicle comprising:
   a. a drive bar having a fitting disposed thereon at a fixed angle relative to said drive bar;
   b. a socket adapted to be removably coupled to an idler pulley work piece; and
   c. a double box end wrench having at least one ratcheting end, said double box end wrench being adapted to be removably attached to said drive bar and said socket,
   wherein said drive bar handle is moveable between
      a first direction that operates on the idler pulley work piece, and
      a second direction that causes said drive bar handle to move relative to said socket.

5. The serpentine belt tool of claim 4, said socket further comprising one of a polygonally shaped opening and a polygonally shaped drive tang.

6. The serpentine belt tool of claim 5, further comprising a crow foot wrench defining one of a polygonally shaped opening and a polygonally shaped tang therein that receives said one of said socket second end polygonally shaped tang and said polygonally shaped opening, and an open end wrench to receive the idler pulley work piece.

7. The serpentine belt tool of claim 4, said double box end wrench defining a polygonally shaped box at a first end opposite said ratcheting wrench.

8. The serpentine belt tool of claim 7, wherein said polygonally shaped box end couples to said drive bar and said ratcheting wrench releasably receives said socket.

9. A serpentine belt tool for removal and installation of a serpentine belt in a vehicle comprising:
   a. a drive bar having a handle at a first end and a fitting at an opposite second end, wherein said fitting is disposed at a fixed angle relative to said drive bar;
   b. a wrench having
      a first end defining a hex shaped opening that is sized to releasably receive said drive bar fitting, and
      an opposite second end defining a ratcheting wrench having a first plurality of teeth on an inner circumference thereof; and
   c. a socket having
      a first end defining a second plurality of teeth on an outer circumference thereof, said socket second plurality of teeth being adapted to be releasably received by said ratcheting wrench first plurality of teeth, and an opposite second end defining one of a hexagonally shaped opening and a square shaped tang adapted to be received by a work piece of a vehicle idler pulley, wherein said drive bar handle is moveable between a first direction that applies torque to the idler pulley work piece, and a second direction that causes said drive bar handle to move relative to said socket.

10. The serpentine belt tool of claim 9, further comprising a crow foot wrench having a first end defining one of a square shaped opening and a hexagonally shaped tang and a second end having an open end wrench formed thereon to receive the idler pulley work piece.

11. The serpentine belt tool of claim 9, further comprising a blow molded case defining a plurality of recessed areas for receiving said drive bar, said double box end wrench and said socket of said serpentine belt tool.

12. A serpentine belt tool for removal and installation of a serpentine belt in a vehicle comprising:

a. a drive bar having a fitting disposed thereon at a fixed angle relative to said drive bar;

b. a socket adapted to be removably coupled to an idler pulley work piece; and c. a wrench having at least one ratcheting end, said wrench being adapted to be removably attached to said drive bar and said socket, wherein said drive bar handle is moveable between a first direction that operates on the idler pulley work piece, and a second direction that causes said drive bar handle to move relative to said socket.

13. The serpentine belt tool of claim 12, said socket further comprising one of a hexagonally shaped opening and a square shaped drive tang.

14. The serpentine belt tool of claim 13, further comprising a crow foot wrench defining one of a square shaped opening and a hexagonally shaped tang and an open end wrench to receive the idler pulley work piece.

15. The serpentine belt tool of claim 12, said wrench defining a hexagonally shaped box at a first end opposite said ratcheting wrench.

16. The serpentine belt tool of claim 15, wherein said hexagonally shaped box end couples to said drive bar and said ratcheting wrench releasably receives said socket.

* * * * *